US008052538B1

(12) United States Patent
Emery, III

(10) Patent No.: US 8,052,538 B1
(45) Date of Patent: Nov. 8, 2011

(54) POKER BILLIARD TABLE AND GAME

(76) Inventor: George B. Emery, III, Laguna Niquel, CA (US)

( * ) Notice: Subject to any disclaimer, the term of this patent is extended or adjusted under 35 U.S.C. 154(b) by 329 days.

(21) Appl. No.: 11/895,550

(22) Filed: Aug. 23, 2007

Related U.S. Application Data

(60) Provisional application No. 60/844,840, filed on Sep. 15, 2006.

(51) Int. Cl.
*A63D 15/20* (2006.01)
*A63D 15/00* (2006.01)

(52) U.S. Cl. ..... 473/23; 473/27

(58) Field of Classification Search ..... 473/23, 473/27, 1, 4, 17, 24, 25; 273/292
See application file for complete search history.

(56) References Cited

U.S. PATENT DOCUMENTS 580,253 A 1/1897 Clarke
666,333 A 1/1901 Stevens
4,516,770 A * 5/1985 Brookes et al. ..... 473/23
4,524,969 A 6/1985 Erzmoneit
4,840,376 A 6/1989 Garret
4,878,664 A * 11/1989 Brookes ..... 473/23
4,948,128 A 8/1990 Emery, III et al.
5,743,815 A 4/1998 Helderman
7,384,341 B2 * 6/2008 Martin et al. ..... 473/27
2007/0090597 A1 * 4/2007 Sharlow ..... 273/292

* cited by examiner

*Primary Examiner* — Mitra Aryanpour
(74) *Attorney, Agent, or Firm* — Dennis W. Beech

(57) ABSTRACT

The present invention may include apparatus and methods for playing a pool game with currency collection and dispensing for tallying betting and paying winnings. A pool table may have six pockets that may be connected to channels structured to channel a ball entering a pocket to move to a ball holding element. A detection channel may be disposed intermediate the channels and the ball holding element. A detector may be disposed with the detection channel with the detector in communication with a controller device. A currency element may be disposed with the controller device to collect currency and to dispense currency as communicated by the controller device. Each of a plurality of balls may have an embedded electronic target device by the detector. A display may be in communication with the controller device.

3 Claims, 2 Drawing Sheets

POKER BILLIARD TABLE AND GAME

This application claims the benefit of U.S. Provisional Application No. 60/844,840, filed on Sep. 15, 2006.

BACKGROUND OF THE INVENTION

This invention relates to apparatus and methods for playing a game of poker pool with a billiard table that may include wagering or betting on the outcome of a game. The new apparatus and method may use an oblong billiard table with six pockets linked to a ball holding area and having a ball detector, displays and an electronic currency collector-dispenser, controller device.

Apparatus and games for playing poker billiards or pool may be known. However, these apparatus may not have the elements necessary for playing a poker pool game that may include autonomous betting and payout of currency for those participating in a poker pool game. Poker pool tables may have apparatus for identifying balls that have entered pockets in the table and for displaying a value for a ball, but may use a complicated pool game that involves more than the normal 15 object balls normally used to play pool. Pool tables may have coin receiving devices that may be used to activate the electronics of a pool table apparatus; however, these devices may not allow inserting currency during game play to tally betting of players and may not dispense currency to the winners of a poker pool game.

SUMMARY OF THE INVENTION

The present invention is directed to apparatus and methods for playing a pool game with currency collection and dispensing for tallying betting and paying winnings. A pool table may have six pockets that may be connected to channels structured to channel a ball entering a pocket to move to a ball holding element. A detection channel may be disposed intermediate the channels and the ball holding element. A detector may be disposed with the detection channel with the detector in communication with a controller device. A currency element may be disposed with the controller device to collect currency and to dispense currency as communicated by the controller device. Each of a plurality of balls may have an embedded electronic target device with a unique identifier to be detected by the detector. A display may be in communication with the controller device.

These and other features, aspects and advantages of the present invention will become better understood with reference to the following drawings, description and claims.

BRIEF DESCRIPTION OF THE DRAWINGS

FIG. 1A illustrates a partial view of a billiard table apparatus controller device and currency element according to an embodiment of the invention;

FIG. 1B illustrates a partial view of a billiard table apparatus display device, game switch and indicator according to an embodiment of the invention;

FIG. 1C illustrates a partial cross-sectional view of a billiard table apparatus rail with a player switch according to an embodiment of the invention;

FIG. 1D illustrates a partial view of a billiard table apparatus separate display according to an embodiment of the invention;

FIG. 4A illustrates a detector, ball and controller device functional relationship according to an embodiment of the invention.

FIG. 4B illustrates a perspective view of a detector according to an embodiment of the invention;

DETAILED DESCRIPTION

The following detailed description represents the best currently contemplated modes for carrying out the invention. The description is not to be taken in a limiting sense, but is made merely for the purpose of illustrating the general principles of the invention.

Figure 1:
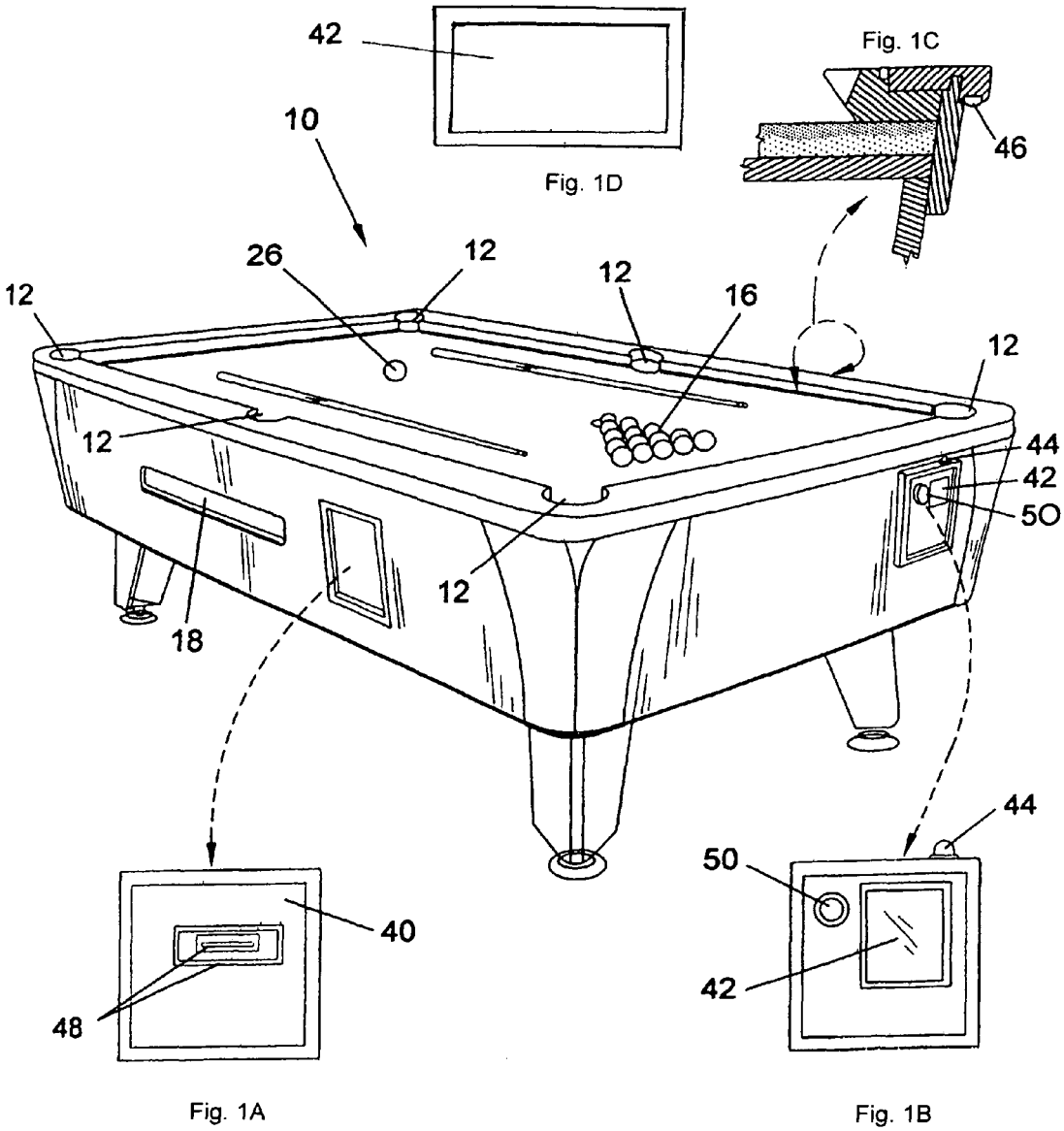
FIG. 1 illustrates a perspective view of a billiard table apparatus according to an embodiment of the invention.
Figure 2:
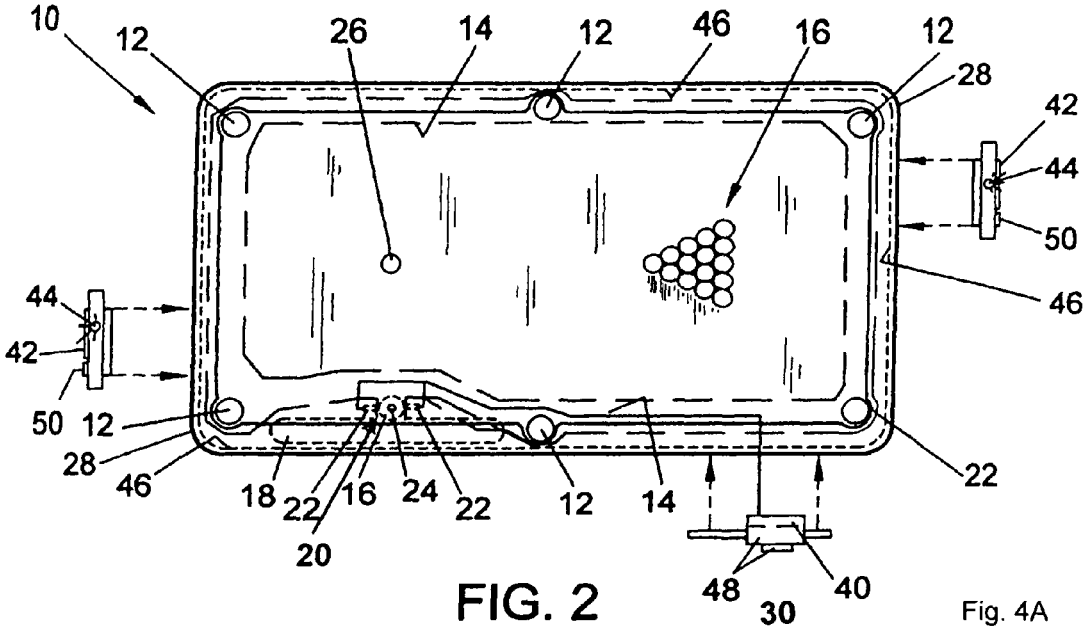
FIG. 2 illustrates a top partial exploded view of a billiard table apparatus for playing poker pool according to an embodiment of the invention.
Figure 3:
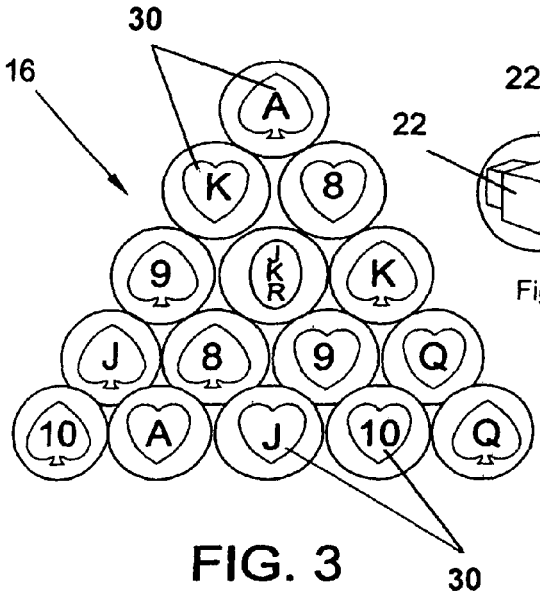
FIG. 3 illustrates an initial ball rack positioning for poker pool according to an embodiment of the invention.
Figure 4:
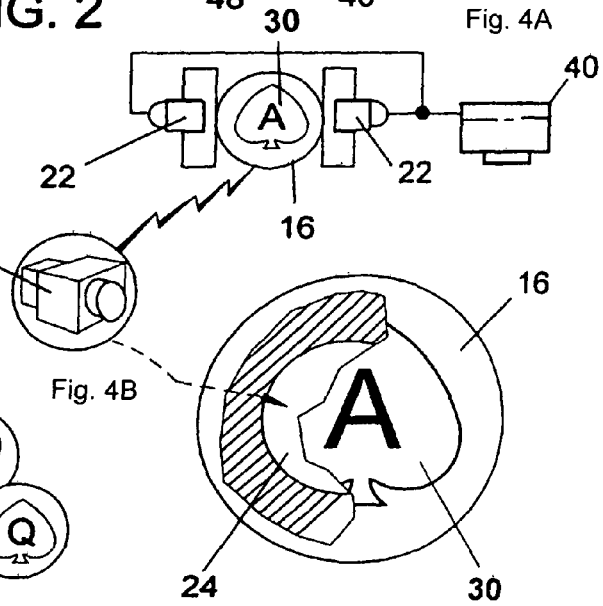
FIG. 4 illustrates a ball partial cross-section with a target device according to an embodiment of the invention.

Referring to FIGS. 1 and 2, a billiard or pool table 10 for playing poker pool and for wagering or betting between players may be an oblong pool table 10 having six pockets 12 that may be connected to channels 14 that may be sloped or otherwise structured to cause balls 16 that enter the pockets 12 to move to a ball holding element 18. The channels 14 may channel balls 16 through a detection channel 20 prior to entry into the ball holding element 18. There may be a reader or detector 22 position with the detection channel 20 to sense passage of a ball 16 and an identification for the ball 16.

The balls 16 may be a total of 15 object balls that may have symbols 30 that may represent values for playing cards as in a poker game. The symbols 30 may be for two suits, for example, hearts and spades, and for values of 8 through ace for 14 balls and a Joker for the $15^{th}$ ball. The balls 16 may have an electronic target device 24 embedded in each ball 16 that may have a unique electronic signature when interrogated by the detector 22. The electronic signature may represent one of the symbols 30 of the values for playing poker. The detector 22 and target device 24 may use electromagnetic wave technology, for example, a radio frequency or RF detector 22 to interrogate a passive target device 24. In the play of a poker pool game a cue ball 26 may be used.

The detector 22 may be in communication with an electronic currency collector-dispenser controller device 40. The controller device 40 may have a processor to record and transmit for display the symbol identification 30 for each ball 16 detected. The controller device 40 may be in electrical communication with one or more displays 42 each of which may be attached at opposite ends 28 of the pool table 10. The display 42 may also be attached to a structure separate from the pool table 10, for example, a display may be attached on a wall of a room or may be hung from an overhead structure. The display 42 may have an indicator 44, for example, a flashing symbol on the display, a flashing light or the like, to indicate a player's turn to play. The indicator 44 may be activated by the controller device 40 in an alternating sequence based on a signal from a player or the detection of a ball 16 by detector 22. There may be a player switch 46 positioned under the pool table 10 rail that may be a sensing switch attached around the perimeter of the pool table 10.

The controller device 40 may have a collector-dispenser currency element 48 or the element 48 and controller device 40 may be separate physical units in communication. The currency element 48 may signal activation of the pool table 10 to the controller device 40 upon receipt of an initial currency. The currency may be paper or coin currency. Additional currency may be collected during a poker pool game as betting by the players. A count of the betting may be tallied by the controller device. When a game may be completed the controller device may activate the currency element 48 to dispense a currency amount to a winning player. There may be a game switch 50 on each display 42 for players to signal the controller device 40 of the end of a game.

The balls 16 may have the symbols 30 fixed thereon in a pyramid or diamond matrix pattern of 4 symbols to aid in viewing a symbol 30 on a ball 16. The balls 16 may also be void of symbols 30. This may allow players to play a poker pool game without knowledge of the value of each ball 16.

A poker pool game for which 15 balls 16 may be used as object balls and a cue ball 26 may be used to pocket the object balls may be played as follows. Two players may each deposit $5.00 in the currency element 48 which may signal the controller device 40 to activate the pool table 10 and release the balls 16 for use in playing. The 15 balls 16 may be racked as illustrated in FIG. 2 with the joker in the center position. A first player may break the balls 16. If one or more balls may be pocketed, the detector 22 may detect the ball values and the controller device 40 may cause those values to be displayed on the display 42. The first player may continue to play as long as a ball 16 is pocketed. A player may remove a value from their display 42, for example, by touching the symbol 30 on the display 42. This may be done twice during a game.

When the first player does not pocket a ball 16 on hitting the cue ball 26 or the first player has pocketed enough balls 16 to create a 5 card symbol poker hand, the second player may play to pocket balls 16 to create a poker hand. If one of the players achieves a five card poker hand, the other player may play until two attempts to pocket balls 16 are missed or a 5 card poker hand may be achieved.

The players may place bets during the play of the game by inserting additional currency in the currency element. The controller device 40 may keep account or a tally of the betting. At the end of a game a winner may be identified and winnings dispensed based on the betting or wagering. If the pool table 10 may have a sponsor, a percentage of the wagers may be retained for collection by the sponsor.

The player switch 46 may be used during a game to cause cycling between players for each players turn to play. The game switch 50 may be used by players to signal the controller device 40 when a game may be considered finished. Balls 16 other than the joker may be designated as a wild card for a poker pool game and such may be stored in the controller device to allow calculating the winning hand. More than two players may play a poker pool game when using 15 balls 16. Poker hands of less than five symbols may also be allowed in a poker pool game of multiple players.

While the invention has been particularly shown and described with respect to the illustrated embodiments thereof, it will be understood by those skilled in the art that the foregoing and other changes in form and details may be made therein without departing from the spirit and scope of the invention.

I claim:

1. A method for playing a pool game using an apparatus with currency collection and dispensing for tallying betting and paying winnings that is scored by forming a poker symbol hand comprising:

a) inserting of currency by at least two players into a currency element in communication with a controller device to activate a pool table and release 15 balls for play wherein said pool table has six pockets that are connected to a plurality of channels structured to channel each of said 15 balls entering one of said six pockets to move to a ball holding element;

b) racking said 15 balls with a joker ball in the center position wherein each of said 15 balls has an electronic target device with a unique identifier embedded therein and each of said electronic target devices is identifiable by a detector;

c) breaking said 15 balls as racked by a first player hitting a cue ball;

d) detecting pocketed balls of said 15 balls caused by said breaking in a detection channel disposed intermediate said channels and said ball holding element wherein said detector is disposed with said detection channel and said detector is in communication with said controller device;

e) displaying the value of each pocketed ball on a display in communication with said controller device;

f) striking said cue ball to urge one or more of said 15 balls into one of the pockets;

g) detecting pocketed balls of said 15 balls and displaying the value of each pocketed ball on said display;

h) removing a value displayed that is not wanted up to a selected allowed number of symbols;

i) repeating actions f) through h) until a pocketed ball is not detected or a poker hand is completed;

j) repeating actions f) through i) until each player has an allowable poker hand;

k) signaling said controller that the game is finished; and l) disbursing the winning currency as calculated and signaled by said controller device to said currency element wherein said currency element is disposed with said controller device and said currency element collects currency the value of which is stored and tallied by the controller device, and said currency element dispenses currency for change and on a signal from said controller device in the event of a game winner.

2. The method as in claim 1 further comprising the step of allowing insertion of currency in said currency element by each player as a bet after action e).

3. The method as in claim 1 further comprising the step of allowing insertion of currency in said currency element by each player as a bet after action i).

* * * * *